United States Patent [19]

Tada et al.

[11] 4,359,643

[45] Nov. 16, 1982

[54] AUXILIARY APPARATUS FOR STARTING A DIESEL ENGINE

[75] Inventors: Yoshiharu Tada; Yoshiaki Abe, both of Higashimatsuyama, Japan

[73] Assignee: Diesel Kiki Co., Ltd., Tokyo, Japan

[21] Appl. No.: 122,618

[22] Filed: Feb. 19, 1980

[30] Foreign Application Priority Data

Feb. 26, 1979 [JP] Japan ..... 54/21612

[51] Int. Cl.[3] ..... F02N 17/02

[52] U.S. Cl. ..... 290/38 R; 290/37 R; 123/179 BG; 123/145 A

[58] Field of Search ..... 290/13, 26, 37 R, 41, 290/38 R; 219/145 A, 497, 498, 499; 123/179 R, 179 B, 179 BG, 145 A

[56] References Cited

U.S. PATENT DOCUMENTS

| | | | |
|---|---|---|---|
| 4,024,408 | 5/1977 | Coleman et al. | 290/38 R |
| 4,088,109 | 5/1978 | Woodruff et al. | 123/179 B |
| 4,137,885 | 2/1979 | Van Ostrom | 123/179 BG |
| 4,258,678 | 3/1981 | Abe | 123/179 BG |

FOREIGN PATENT DOCUMENTS 2913101 11/1979 Fed. Rep. of Germany ... 123/145 A

*Primary Examiner*—A. T. Grimley
*Assistant Examiner*—D. L. Rebsch
*Attorney, Agent, or Firm*—Guy W. Shoup; Gerard F. Dunne

[57] ABSTRACT

In an auxiliary apparatus for starting a diesel engine having a quick preheating circuit operable by the switching of a key-switch from its OFF to ON position and an afterglow circuit operated by the return of the key-switch from the ST position to ON position, there is provided a heat maintenance preheating circuit to maintain the temperature of the glow plugs for a predetermined time after the quick preheating operation is finished. The heat maintenance preheating circuit for maintaining the temperature begins its operation just after the immediate heating operation by the quick preheating circuit is finished, and continues its operation for a predetermined period while the key-switch is at its ON position. As a result, even when the engine is not started to operate immediately after the initial preheating, the temperature of the glow plugs is kept at the predetermined temperature, thus assuring smooth starting of the engine.

5 Claims, 4 Drawing Figures

| Fig. 1A | Fig. 1B | Fig. 1C |
|---|---|---|

AUXILIARY APPARATUS FOR STARTING A DIESEL ENGINE

The present invention relates to an auxiliary apparatus for starting a diesel engine, and more particularly to improvements in an apparatus which is utilized to facilitate starting of a cold diesel engine.

A conventional auxiliary device for starting a cold diesel engine has a circuit including glow plugs typically charged from a capacitor whose charge level is altered in response to the temperature of the glow plugs or, perhaps, the engine temperature. In such a device for starting a engine, the preheating time for the glow plugs is controlled by the charging voltage on the capacitor and a pilot lamp is lit during the preheating operation. Consequently, the preheating operation for the glow plugs is started just after a key-switch is switched over from the off position to the on position, and the pilot lamp is lit. When the temperature of the glow plug reaches a required preheating temperature, this preheating condition is typically detected on the basis of the value of the charging voltage on the capacitor and the current flowing through the glow plugs is cut off. At the same time, the pilot lamp is turned off.

In such conventional auxiliary devices constructed as described above, a smooth starting operation will be guaranteed when the operation for starting the engine is begun just after the preheating operation is finished. However, if the operation for starting the engine is made a short time thereafter, smooth starting operation of a cold engine would not be expected since the temperature of the glow plugs may drop below the temperature necessary for smooth starting.

In addition, even if the engine succeeds in being started, since the engine does not easily become warm when it is cold, the combustion of the engine is not very efficient. Therefore, the engine is liable to operate under inperfect combustion, and produce smoke. In such a condition, the engine also tends to stall even if the engine succeeds in starting.

It is therefore an object of the present invention to provide an auxiliary apparatus for starting a diesel engine which is free from the disadvantages involved in the above-mentioned conventional apparatus.

It is another object of the present invention to provide an auxiliary apparatus for starting a diesel engine which is capable of keeping the temperature of the glow plugs at a predetermined preheating temperature for some time after finishing a quick preheating operation.

It is still another object of the present invention to provide an improved auxiliary apparatus for starting a diesel engine, which is capable of facilitating starting of a cold diesel engine.

It is a further object of the present invention to provide an auxiliary apparatus in which smooth starting of the cold diesel engine can be expected even during the winter season.

According to the present invention, in an auxiliary apparatus for starting a diesel engine having a quick preheating circuit operable by the switching of a key-switch from its OFF to ON position and an afterglow circuit operable by the return of the key-switch from the ST position to ON position, there is provided a heat maintenance preheating circuit to maintain the temperature of the glow plugs for a predetermined time after the quick preheating operation is finished. The heat maintenance preheating circuit for maintaining the temperature begins its operation just after the immediate heating operation of the quick preheating circuit is finished, and continues its operation for a predetermined period while the key-switch is at its ON position. As the result, even when the engine is not started to operate soon after the immediate preheating, the temperature of the glow plugs is kept at the predetermined temperature, thus assuring smooth starting of the engine. According to a preferable embodiment of this invention, the operation of the after-glow circuit is controlled by at least one engine condition, such as the revolutional speed of the engine, the voltage of the battery, exhaust gas temperature, or the engine temperature. Any over preheating of the engine may thus be avoided and also the over-heating of the glow plugs may be prevented. Further, according to the present invention, there is provided a relay which is used for avoiding any fall in the voltage applied to the glow plugs due to a fall of the voltage of the starter motor being placed in operation. The relay is controlled by at least one of several engine conditions, such as revolutional speed of the engine or the voltage of the battery, through a relay controlling circuit. As the result thereof, the fall of the preheating temperature at the time of operation of the starter motor may be avoided.

The other objects and advantages of this invention will be made apparent from the detailed description made with reference to the accompanying drawings, in which.

Figures 1, 1A:
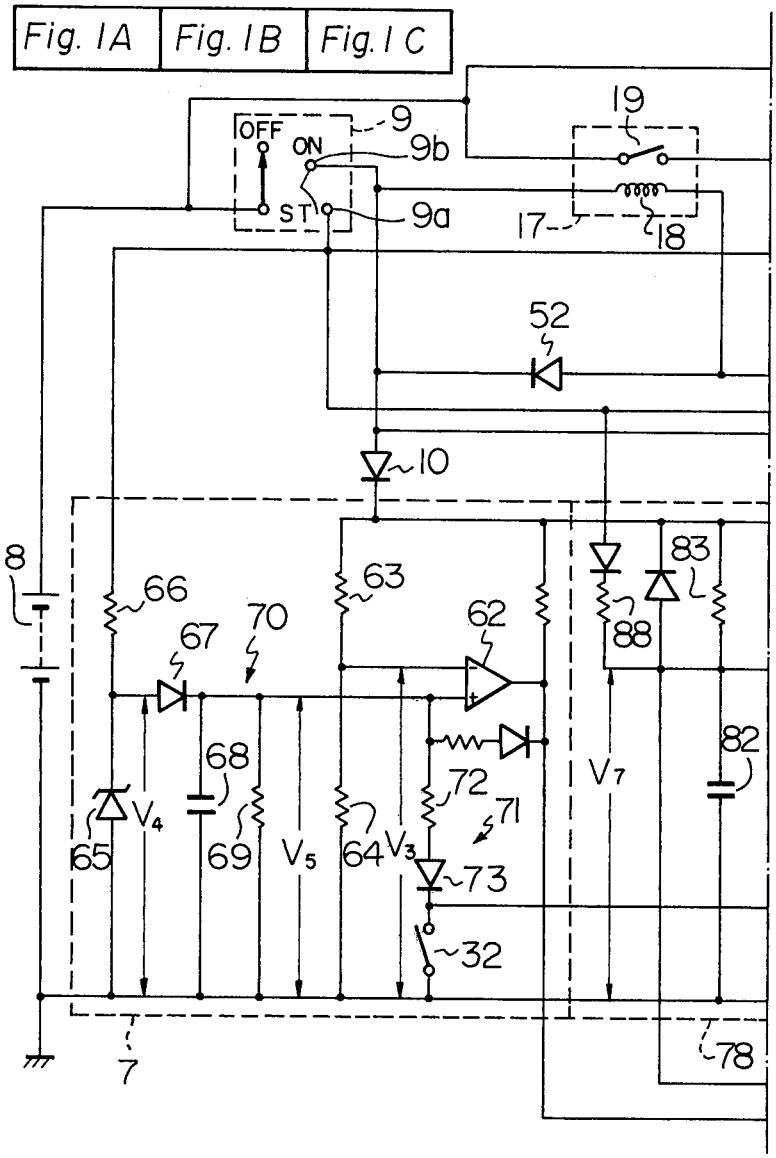
FIG. 1 is a circuit diagram of an illustrative embodiment of a starting auxiliary apparatus of this invention.
Figure 1B:
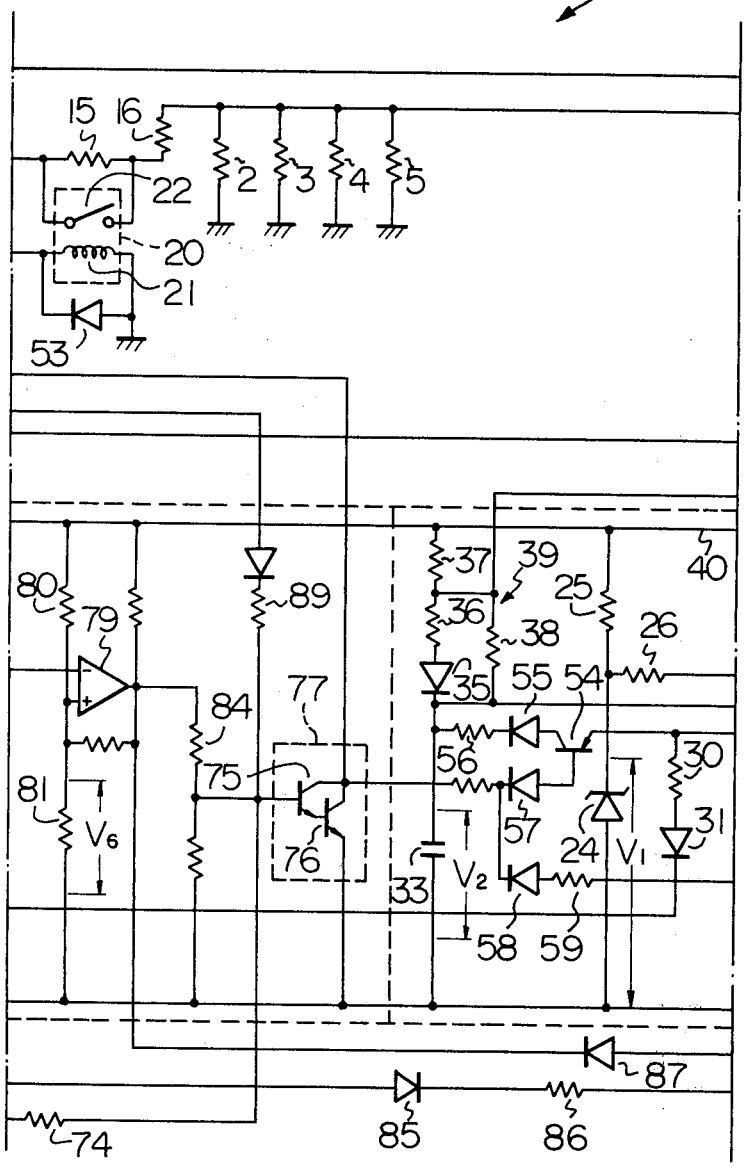
Figure 1C:
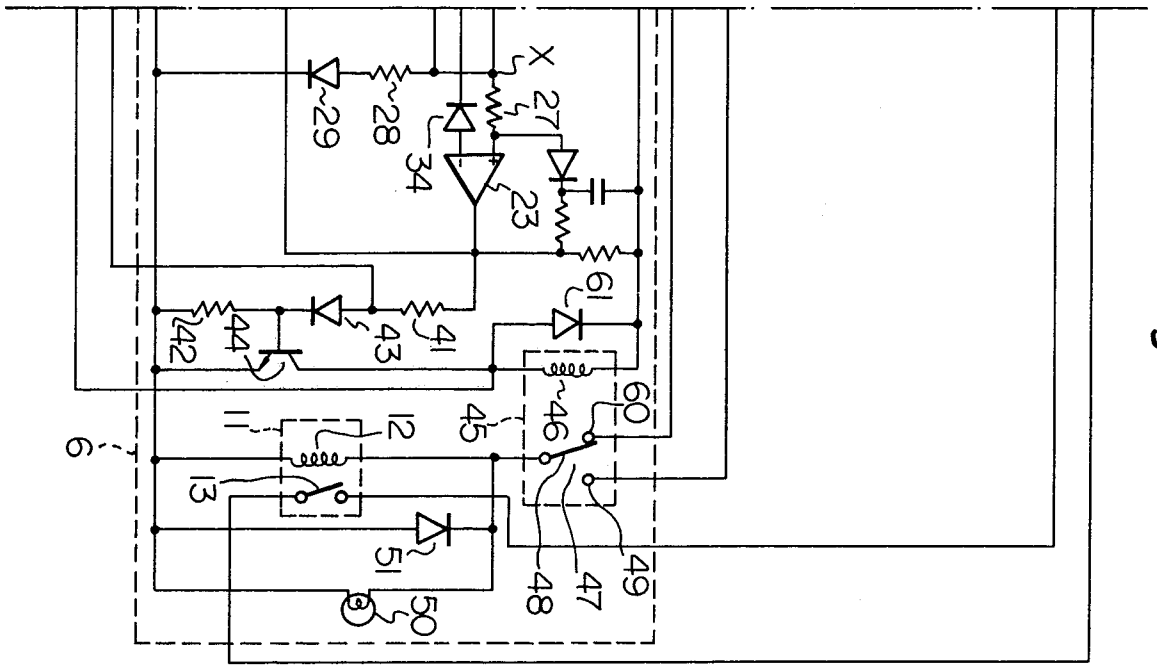

In FIG. 1, an auxiliary device 1 is indicated which is to be assembled with the conventional diesel engine, not shown, to control the preheating condition of glow plugs 2 to 5 provided for respective cylinders of the diesel engine. A four cylinder engine having four glow plugs is employed in the illustrative embodiment. It is well understood, however, that the present invention may equally be applied to a diesel engine having any number of cylinders. The auxiliary device 1 is provided with a quick-preheating circuit 6 for rapidly preheating the glow plugs 2 to 5 up to the predetermined temperature and an after-glow circuit 7 for heating the glow plugs for a determined time after the engine is started. To these circuits 6 and 7 is applied a voltage from a battery 8 through a key-switch 9, which can take the three switching positions of OFF, ON and START (ST) positions. When the key-switch 9 is OFF, power is not supplied to the circuits. On the other hand, when the key-switch 9 is switched over to the ON position, the power from the battery 8 is supplied to the circuits through a diode 10. The four glow plugs 2 to 5 are connected in parallel with each other and are connected with the battery 8 through a normally open switch 13 which is closed by the energization of the coil 12 of a relay 11 in the quick-preheating circuit 6. The switch 13 is connected in parallel with a series circuit of temperature control resistors 15, 16 and a normally open switch 19 which is closed by the energization of the coil 18 of a relay 17 as will be described more fully below. The temperature control resistor 15 is connected in parallel with a normally open switch 22 to be closed by the coil 21 of a relay 20. The coil 21 is connected between the ST contact 9*a* of the key-switch 9 and the ground, and the switch 22 is closed when the key-switch 9 is changed-over to its ST position to shunt the temperature control resistor 15 and increase the current flowing through the switch 19. Diodes 51, 52 and 53 are connected in parallel with the coils 12, 18 and 21, respectively and they suppress the induction voltage generated in the respective coils.

The quick preheating circuit 6 includes an operational amplifier 23, and to the non-inventing input terminal thereof is applied a bias voltage $V_1$ produced by a zener diode 24 and a resistor 25 through resistors 26 and 27. The connecting point X between the resistors 26 and 27 is grounded through a resistor 28 and a diode 29. The point X is also grounded through a resistor 30, a diode 31 and a water temperature detecting switch 32. The switch 32 is a normally open switch and is closed when the water temperature of the engine reaches and exceeds a predetermined degree, such as 100° C., thus the potential of the connecting point X is controlled by the water temperature.

On the other hand, to the inverting input terminal of the operational amplifier 23 is applied a charging voltage $V_2$ produced across a capacitor 33 through a diode 34. One end of the capacitor 33 is connected with a positive line 40 through a passive network 39 consisting of a diode 35, resistors 36, 37 and 38. The positive line 40 is connected to the ON contact 9*b* of the key-switch 9 through the diode 10. Therefore when the key-switch 9 is changed-over to its ON position, the charging voltage $V_2$ rises according to the time constant $\tau_1$ which is determined by the combined resistance value of the passive network 39 and the capacitance value of the capacitor 33. As the result, the output level of the operational amplifier 23 is high until the inverting input terminal voltage thereof becomes larger than that of the non-inverting input. During the high output level from operational amplifier 23, a transistor 44 biased with resistors 41, 42 and a diode 43 keeps its ON state. The coil 46 of a relay 45 is therefore energized and the movable contact 48 of the changing-over switch 47 in the relay 45 contacts with a fixed contact 49 to energize the coil 12. With this energization, the switch 13 is closed and the respective glow plugs are directly heated by the application of current from the battery 8. At the same time, a lamp 50 connected in parallel with the coil 12 is lighted, which indicates that the device 1 is under the quick preheating operation. The collector of a transistor 54 is connected with a connecting point of the capacitor 33 and the diode 35 through a diode 55 and a resistor 56, while the emitter of the transistor 54 is connected with the point X. The base of the transistor 54 is connected with the output terminal of the operational amplifier 23 through diodes 57, 58 and a resistor 59, and the charging voltage of the capacitor 33 may therefore be controlled also by the output level of the operational amplifier 23. After a predetermined time $t_1$ has passed from the turning of the key-switch 9 to its on position, the inverting input terminal voltage of the operational amplifier 23 becomes larger than that of its non-inverting input terminal due to the increase of the charging voltage $V_2$. As the result, the output level of the operational amplifier becomes low. The transistor 44 thus becomes OFF and the movable contact 48 moves into contact with a fixed contact 60. The relay 11 is thus deenergized and the lamp 50 is turned off. On the other hand, a diode 61 connected in parallel with the coil 46 absorbs the induced voltage generated across the coil 46.

Now an explanation will be given on the after-glow circuit 7. The circuit 7 comprises an operational amplifier 62 having an inverting input terminal to which a bias voltage $V_3$ divided by resistors 63, 64 is applied. The contact 9*a* of the ST position of the key-switch 9 is connected through a resistor 66 with the cathode of a zener diode 65, whose anode is grounded. A constant voltage $V_4$ produced across the zener diode 65 is applied to a charge and discharge circuit 70 through a diode 67. The circuit 70 comprises the parallel circuit of a capacitor 68 and a resistor 69, and is connected between the non-inverting input terminal of the operational amplifier 62 and the ground. The voltage $V_5$ between the both ends of the circuit 70 is applied to the non-inverting input terminal of the operational amplifier 62. The discharge time constant of the capacitor 68 depends on the value of the resistor 69. An additional circuit 71 is connected in parallel with the resistor 69 in order to change the discharge time in accordance with the water temperature in the engine. The additional circuit 71 comprises a series circuit, including the water temperature detecting switch 32, a resistor 72 and a diode 73. By the closure of the switch 32 the effective resistance of the circuit 71 is placed in parallel with resistor 69 and the discharge time of the capacitor 68 becomes smaller. The output of the operational amplifier 62 is input as a control signal into a switch 77 comprised of two transistors 75 and 76, through a resistor 74. The transistors 75 and 76 are connected in the form of the Darlington connection with each other. The switch 77 is used for the control of the relay 17 and when the potential of the base of the transistor 75 becomes high in level, the coil 18 is energized. Therefore, when the key-switch 9 is positioned at the ON position, the voltage $V_3$ is applied to the inverting input terminal of the operational amplifier 62 and while the output of the operational amplifier 62 is low in level, since the non-inverting input terminal thereof is grounded through the resistor 69. Changing-over the key-switch 9 from its ON position however, charges to ST position, the capacitor 68 through a resistor 66 until it reaches the voltage determined by the Zener diode 65 and thereby the output level of the operational amplifier 62 becomes high. As the result, the switch 19 is closed and a preheating current flows into the glow plugs 2 to 5 through the resistors 15 and 16. Due to the increased load of the resistors 15 and 16, the preheating current flowing to glow plugs 2 to 5 is less than that flowing initially from closing of the relay 13 of the quick preheating circuit 6.

After the engine begins its revolution, when the key-switch 9 is returned from its ST position to ON position, the charge and discharge circuit 70 then assumes its discharge mode and the value of the voltage $V_5$ falls in accordance with the time constant of the charge and discharge circuit 70. After a predetermined time has passed, the voltage applied to the non-inverting input terminal of the operational amplifier 62 becomes lower than the voltage $V_3$ by the discharge of the capacitor 68, and the output level of the operational amplifier 62 becomes low in level and the coil 18 is deenergized to terminate the preheating operation of the glow plugs 2 to 5. As will be seen from the above explanation, the after-glow time, that is the duration from the return of the key-switch 9 from its ST position to ON position till the end of the preheating by the after-glow circuit 7, is determined by the discharge time constant of the capacitor 68. Therefore, if the water temperature is higher than the determined value, the after-glow time is short; when the temperature is below the above value, it becomes longer.

The auxiliary apparatus for starting the diesel engine of this invention is further provided with a heat maintenance preheating circuit 78 for maintaining the predetermined temperature of the glow plugs for a predetermined time even after the termination of the quick preheating operation by the quick preheating circuit 6. It will be realized that the provision of this heat maintenance preheating circuit 78 is one of the important features of this invention. The heat maintenance preheating circuit 78 has an operational amplifier 79 having a non-inverting input terminal receiving a predetermined constant voltage $V_6$. The voltage $V_6$ is produced by a voltage dividing circuit consisting of resistors 80 and 81. A capacitor 82 is connected between ground and an inverting input terminal of the operational amplifier 79, and the current for charging the capacitor 82 flows through a resistor 83 when the key-switch 9 is switched over into the ON position. The charging voltage $V_7$ produced across the capacitor 82 is applied to the inverting input terminal of the operational amplifier 79 to thereby control the amplifier 79. The output level of the operational amplifier 79 is high when the voltage $V_6$ is higher than $V_7$, and the output level is applied to the base of the transistor 75 through a resistor 84. Consequently, the output level of the operational amplifier 79 is high just after the key-switch 9 is changed to the ON position, and it becomes low after the lapse of a predetermined time therefrom. However, since the power source and the glow plugs 2 to 5 is directly connected by the operation of the quick preheating circuit 6, the quick preheating continues irrespective of the operation of the heat maintenance preheating circuit 78.

While the quick preheating circuit 6 is in operation, the charging voltage of the capacitor 82 is suppressed low, and for this purpose, there is connected between the inverting input terminal of the operational amplifier 79 and the collector of the transistor 44 a series circuit consisting of a diode 85 and a resistor 86 as indicated in FIG. 1. Therefore, when the transistor 44 is in its on state, the glow plugs 2 to 5 start to be quickly preheated and the inverting input terminal of the operational amplifier 79 is then grounded through the diode 85 and the resistor 86. Thus, the voltage $V_7$ is suppressed lower than $V_6$. As the result, the output of the operational amplifier 79 is kept high in level at least during the quick preheating operation. In case the quick preheating is stopped for any reason, the voltage $V_7$ begins to rise and it exceeds $V_6$ after the lapse of a predetermined time period. In this time period after the termination of the quick preheating operation, the current for maintaining the temperature may be flowed into the glow plugs 2 to 5 through the switch 19 and the load varying temperature control resistors 15, 16. It may be said therefore the termination of the quick preheating may be overlooked. The output terminal of the operational amplifier 79 is connected with the connecting point between the resistor 41 and the diode 43 through a diode 87 and thus the transistor 44 is forced to change to OFF when the output level of the operational amplifier 79 becomes low.

By the changing over of the key-switch 9 from its ON position to ST position, the capacitor 82 is charged evenly through a resistor 88, and the output of the operational amplifier 79 is quickly made low and stops the operation of the heat maintenance preheating circuit 78. As long as the key-switch 9 is at its ST position, however, the current flowing through a resistor 89 keeps the switch 77 ON and continues the preheating for maintaining the temperature of the glow plugs. At the same time, the relay 20 is energized, which by-passes the resistor 15 for maintaining the temperature. The fall of the temperature of the glow plugs 2 to 5 according to the fall of the battery voltage caused by the operation of a starter motor may therefore effectively be avoided.

According to the circuit construction as above explained, by changing-over the key-switch 9 from OFF position to ON position, the switch 13 of the quick preheating circuit 6 is closed so as to rapidly heat the glow plugs 2 to 5 with a relatively large current. At this time, the switch 19 is closed by the operation of the heat maintenance preheating circuit 78, and the glow plugs 2 to 5 are heated directly by the battery 8 through the switch 13. The after-glow circuit 7 is at this time under the non-operative condition. After a predetermined time has passed, the relays 45 and 11 are deenergized due to the rise of the charging voltage on capacitor 33, the quick preheating operation terminates, while the charging operation of the capacitor 82 is started due to the OFF condition of the transistor 44. The charging operation of the capacitor 82 is made through the resistor 83. After a predetermined time has then passed, the temperature of the glow plugs 2 to 5 is maintained by a reduced current flow until the voltage $V_7$ becomes larger than $V_6$. In other words, the temperature of the glow plugs may be maintained for a predetermined time even if the key-switch 9 is still at its ON position after the quick preheating.

In this case, the charge of the capacitor 33 is discharged through the coil 12 when the coil 12 is connected to the contact 60, and the output level of the operational amplifier 23 is again made high. The time when the output level of the operational amplifier 23 becomes high is set later than the termination of the heat maintenance operation by the heat maintenance preheating circuit 78. For this reason, the transistor 44 is forced to become OFF before the output level of the operational amplifier 23 becomes high. Therefore, even when the heat maintaining operation terminates while the key-switch 9 is at the ON position, the quick preheating operation is not made.

After the termination of the quick preheating, the key-switch 9 is changed-over from ON position to ST position. The charge current now flows into the capacitor 82 also through the resistor 88 to rapidly charge the capacitor 82. As the result, the output of the operational amplifier 79 in the heat maintenance preheating circuit 78 becomes low within a very limited time. On the other hand, when the key-switch 9 takes the ST position, the charging operation of the capacitor 68 beings and when the voltage $V_5$ becomes larger than the voltage $V_3$, the switch 77 becomes ON. As the result, the switch 17 turns on irrespective of the output level of the operational amplifier 79, thereby heating the glow plugs 2 to 5. At the same time, the coil 21 is energized and the glow plugs are heated with the larger heating current than that for maintaining temperature, to proceed with the after glow operation.

By returning the key-switch 9 from the ST position to the ON position, the capacitor 68 discharges and after a predetermined time; the output level of the operational amplifier 62 becomes low. The relays 17 and 20 are thereby deenergized and the heating operation of the glow plugs according to this device is stopped.

Figure 2:
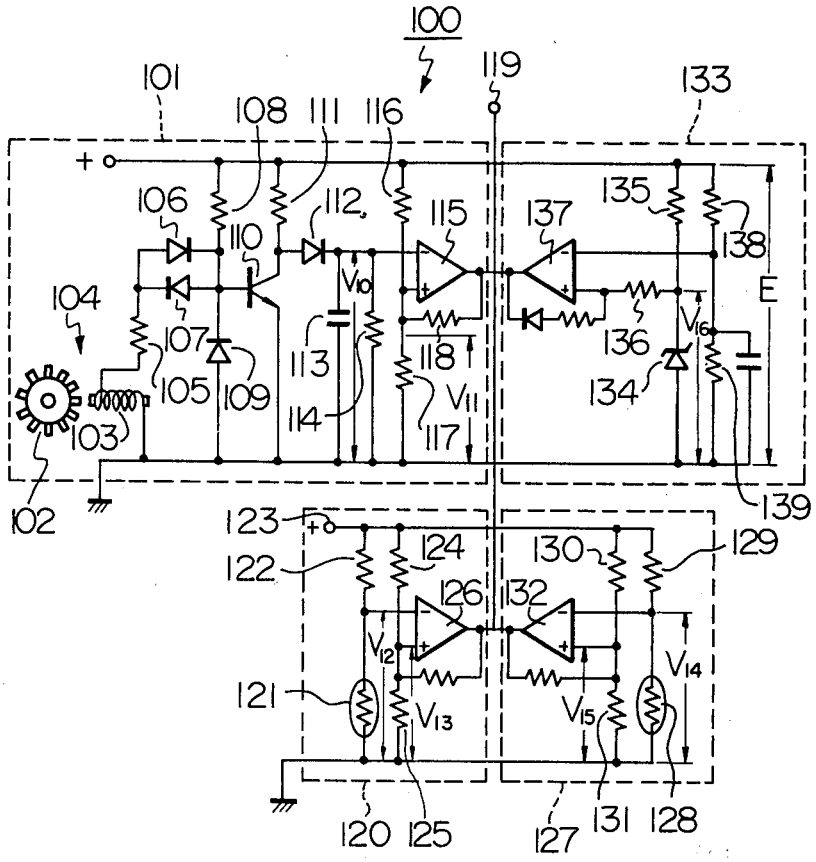
FIG. 2 is a circuit diagram of a correcting device to be applied to the circuit of FIG. 1.

In FIG. 2, a correcting device 100 for the after-glow circuit 7 is shown. The device 100 stops the operation of the after-glow circuit 7 when at least one of the factors among the revolutional speed of the engine, the battery voltage, the exhaust gas temperature and the engine temperature (temperature of cooling water or oil) exceeds a predetermined value. The device 100 includes a revolutional speed detecting circuit 101. 101 includes a transducer circuit 104 which produces an electric signal corresponding to the revolutional speed of the engine. The transducer circuit 101 includes a revolutional speed to electric signal converter 104 that comprises a gear 102 mounted on the crank shaft of the engine, not shown, and a pick-up coil 103. The gear teeth move one by one past the coil 103 to vary the inductance in the coil to produce an alternating current signal. The frequency of the alternating current signal from the coil 103 is in proportion to the revolutional speed of the engine and is input to a transistor 110 through a resistor 105, and diodes 106, 107, the transistor 110 being biased by a resistor 108 and a diode 109. The output voltage produced in a load resistor 111 at the collector of the transistor 110 is applied to a capacitor 113 through a diode 112 to charge it. The voltage $V_{10}$ proportional to the revolutional speed therefore appears across the capacitor 113, which is applied to the inverting input terminal of an operational amplifier 115. A resistor shown with the numeral 114 is to discharge the charge of the capacitor 113 with an appropriate time constant so that the value of the voltage $V_{10}$ changes according to the change of the revolutional speed N of the engine. To the non-inverting input terminal of the operational amplifier 115 is applied a predetermined constant voltage $V_{11}$ divided by two resistors 116 and 117. Also, the output of the operational amplifier 115 is fedback to the non-inverting input terminal through a resistor 118. For this reason, when the revolutional speed N is low, the voltage $V_{10}$ is lower than $V_{11}$ and the output of the operational amplifier 115 is high. On the other hand, when the revolutional speed N becomes high and the voltage $V_{10}$ becomes larger than $V_{11}$, the output of the operational amplifier 115 becomes low.

The numeral 120 indicates an exhaust gas temperature detecting circuit, which detects whether the temperature of the exhaust gasses exceeds a predetermined value. A voltage $V_{12}$ being in proportion to the temperature of the exhaust gas is obtained by the series circuit of a positive characteristic thermistor 121 and a resistor 122, which are inserted between the ground and a positive line 123. The thermistor 121 changes its resistance according to the temperature of the exhaust gases. The voltage $V_{12}$ is applied to the inverting input terminal of an operational amplifier 126, while to the non-inverting input terminal of the amplifier 126 is inputted a constant voltage $V_{13}$ which is divided by resistors 124 and 125. When the temperature T exceeds a predetermined value and the voltage $V_{12}$ becomes larger than $V_{13}$, the output level of the operational amplifier 126 becomes low.

An engine temperature detecting circuit 127 for detecting the temperature of the engine includes a positive temperature characteristic thermistor 128 for detecting the temperature of the cooling water of the engine and is similarly constructed to the exhaust gas temperature detecting circuit 120. Therefore when the temperature of the cooling water becomes higher than the predetermined value, a voltage $V_{14}$ obtained from the division by the thermistor 128 and a resistor 129 becomes larger than a voltage $V_{15}$ obtained from the division by resistors 130 and 131. Thus the output from an operational amplifier 132 becomes low.

A battery voltage detecting circuit 133 has an operational amplifier 37 and to the non-inverting input terminal thereof is applied a constant voltage $V_{16}$ produced by a Zener diode 134 and a resistor 135. On the other hand, a battery voltage E divided by resistors 138 and 139 is applied into the inverting input terminal thereof. The resistors 138 and 139 detect the change of the voltage E and make the output level of the operational amplifier 137 low when the voltage E reaches and exceeds a predetermined value.

A terminal 119 is connected with the output terminal of the operational amplifier 62, and when any one of the output levels of the operational amplifiers 115, 126, 132 and 137 becomes low, the operation of the afterglow circuit 7 is stopped. In other words, the operation of the after-glow circuit 7 may be stopped if the revolutional speed of the engine rises over a predetermined value; the battery voltage E reaches and exceeds a predetermined value; or the temperature of the exhaust gas and/or the engine exceeds the predetermined value. Therefore any unnecessary preheating and excess-heating of the glow plugs may effectively be avoided.

It should be understood that the detection of the engine temperature may be possible by the detection of the oil temperature in place of that of the cooling water.

Figure 3:
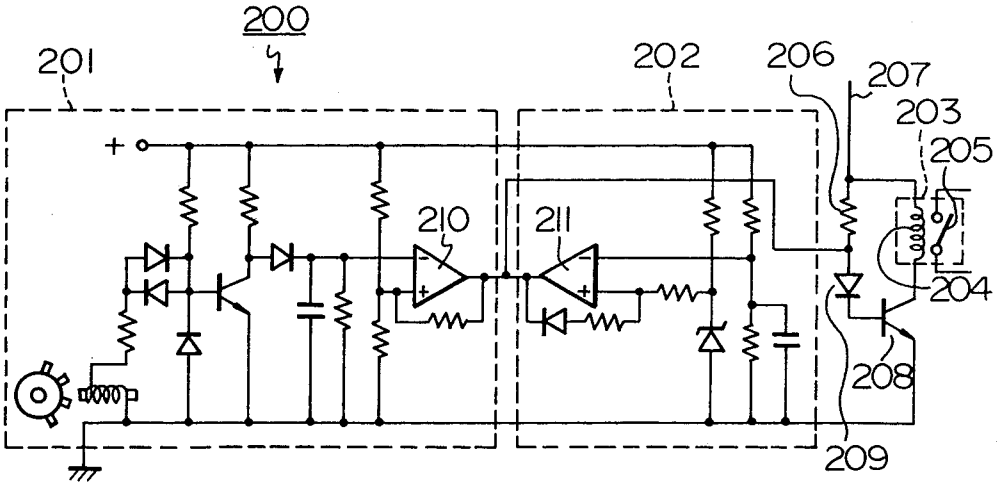
FIG. 3 is a circuit diagram of another correcting device for the circuit of FIG. 1.

In FIG. 3, there is shown a relay control circuit 200 for avoiding the fall of the preheating temperature at the time of operation of the starter motor. The relay control circuit 200 includes a revolutional speed detecting circuit 201 to detect the revolutional speed of the engine and a battery voltage detecting circuit 202 to detect the fall of the battery voltage from the predetermined value. These circuits 201 and 202 are the same in construction with the circuits 101 and 133 of FIG. 2, respectively. Therefore explanation thereon will not be made here.

A relay 203 comprises a coil 204 and a normally open switch 205 and corresponds to the relay 20 shown in FIG. 1. One end of the coil 204 is connected with the ST contact 9*a* of the key-switch 9 together with one end of a resistor 206 through a line 207, while the other end thereof is connected with the collector of a switching transistor 208 whose emitter is grounded. The base of the transistor 208 is connected with the cathode of a diode 209 whose anode is connected with the other end of the resistor 206. To the connecting point between a diode 209 and the resistor 206 is connected the outputs of the respective circuits 201 and 202. Therefore, by the changing-over of the key-switch 9 into the ST position, the transistor 208 is turned on, thereby energizing the relay 203. Thus the flow of the current into the glow plugs 2 to 5 is made by by-passing the resistor 15 in order to prevent the fall of the preheating temperature. In this case, by the rise of the revolutional speed of the engine, the output of the operational amplifier 210 of the circuit 201 becomes low in level. On the other hand, by the rise of the battery voltage, the output of the operational amplifier 211 of the circuit 202 becomes low.

Therefore, if either circuit output becomes low level, the transistor 208 is switched OFF and the switch 205 of the relay 203 for preventing the fall of the preheating temperature is opened at the time of operation of the starter motor. Thus the excess heating of the glow plugs by, for example, the rise of the battery voltage may be avoided.

Figure 4:
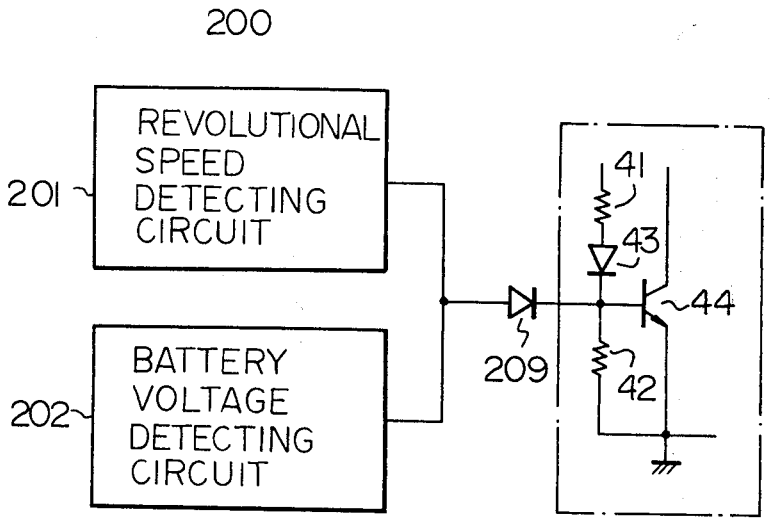
FIG. 4 is a circuit diagram showing different connection of the correcting device of FIG. 3.

In FIG. 3, the quick preheating relay 11 may be used in place of the relay 203 being used for preventing the fall of the preheating temperature at the time of operation of the starter motor. For this purpose, the relay 203 and the transistor 208 are deleted from the circuit of FIG. 3 and the catchode of the diode 209 is connected with the base of the transistor 44 in the quick preheating circuit 6 in FIG. 1, thus dispensing with the relay 203, as shown in FIG. 4.

As fully explained above, according to the apparatus for starting the diesel engine of this invention, the starting ability of the engine is maintained by its heat maintenance preheating circuit even if the starting operation is not immediately made after the termination of the quick preheating operation. By providing the after-glow circuit, the starting ability has been improved. Further by assuring the correction of the revolutional speed, voltage and temperature (of water, oil and exhaust gas), the excess heating of the glow plugs may be avoided.

Further variations and modifications can be effected within the spirit and scope of the invention.

What is claimed is:

1. An apparatus for use in starting a diesel engine having at least one glow plug energized by actuation of an ignition switch having a first position for connecting said apparatus to a voltage source and a second position for starting the diesel engine, said apparatus comprising:

preheating means responsive to the first position of said ignition switch for passing current to each said glow plug for a predetermined time period, said current being of a first level sufficient for heating each said glow plug relatively quickly;

after-glow means responsive to the second position of said ignition switch for passing a second level of current below said first level for maintaining the temperature of each said glow plug during starting of said diesel engine; and heat maintenance means responsive to said first position of said ignition switch for passing a level of current below said first level to each said glow plug for maintaining the temperature thereof if said ignition switch should be kept in its first position for a time period longer than said predetermined time period of said preheating means.

2. An apparatus according to claim 1, said after-glow means including a timing means for passing the current level thereof for a selected time period and means responsive to the temperature of the diesel engine for shortening said selected time period when the temperature of the diesel engine is above a selected value.

3. An apparatus according to claim 1, said heat maintenance means including a voltage comparator receiving a reference voltage at one input and having a timing capacitor connected to the other input thereof, means responsive to the first position of said ignition switch for supplying current to said capacitor and switch means responsive to said voltage comparator for supplying the current level of said heat maintenance means to each said glow plug when the voltage level of said capacitor is below that of said reference voltage.

4. An apparatus according to claim 3, said heat maintenance means further including means for holding the voltage level of said capacitor below that of said reference voltage during operation of said preheating means.

5. An apparatus according to claim 3 or 4, said heat maintenance means further including means inhibiting operation of said preheating means upon termination of operation of said heat maintenance means.

* * * * *